United States Patent [19]

Richardson

[11] Patent Number: 5,042,809

[45] Date of Patent: Aug. 27, 1991

[54] COMPUTERIZED GAMING DEVICE

[76] Inventor: Joseph J. Richardson, 21 S. Sixth St., Fargo, N. Dak. 58103

[21] Appl. No.: 616,236

[22] Filed: Nov. 20, 1990

[51] Int. Cl.[5] ..... A63F 1/00

[52] U.S. Cl. ..... 273/138 A; 273/85 CP; 273/460

[58] Field of Search ..... 273/138 A, 85 CP, 85 G, 273/460

[56] References Cited

U.S. PATENT DOCUMENTS

| | | | |
|---|---|---|---|
| 3,909,002 | 9/1975 | Levy | 273/138 A |
| 4,467,424 | 8/1984 | Hedges et al. | 273/138 A X |
| 4,614,342 | 9/1986 | Takashima | 273/138 A X |

*Primary Examiner*—William H. Grieb
*Attorney, Agent, or Firm*—Moore & Hansen

[57] ABSTRACT

A computerized gaming device and method of playing casino-type games of chance wherein a player chooses a game to play from a plurality of games displayed on a video screen. Each game has a finite number of chances per deal and a video display of the chances of winning when a deal is new, the percentage of winning chances remaining, the possible winning symbol combinations, and how many major winning chances remain. In addition, a displayed record is kept of the player's cash credit with a print out of wins and losses when he quits to claim any winnings. A provision is made to retire a deal or game whenever all the major winning chances have been won or when there are no more winning chances remaining. The player can quit at any time or call for a new deal screen after playing at least one chance in a deal.

27 Claims, 7 Drawing Sheets

COMPUTERIZED GAMING DEVICE

BACKGROUND OF THE PRESENT INVENTION

1. Field of the Invention

The present invention relates to a computerized gaming device and method of playing such a casino game.

2. Prior Art

Pull-tab games in paper form have existed for many years and are commonly played in state regulated charitable gambling institutions. Likewise, computerized gaming machines simulating casino slot machine games are common. However, none are known that computerize games of chance such as pull-tab games.

Known prior art is in the form of paper tickets packaged in fixed number lots with a fixed payout and therefore, fixed profit. Such games vary in size from approximately 1,000 to 4,000 chances per lot or deal; and the payouts vary from deal to deal from a low of 60% to a high of 84% approximately. The payout of such games is usually in five or six tiers: 4 winning tickets in the highest tier, 4 winning tickets in the second tier, 4 winning tickets in the third tier, 12 winning tickets in the fourth tier, and 200 small winners which often return only 1 or 2 times the cost of a ticket.

Many state regulations require that non-profit organizations who operate charitable gaming tickets (CGTs) place all of the tickets from a deal in a transparent container. This allows the players to see that winning tickets are not pulled from a separate place, envelope, or pocket as they were back when carnivals used this type of game. By looking at the container, players are able to get a rough estimation of how many tickets are left in that container. State regulations often require that an organization display what is called a flare for each game. The flare is a poster which shows the player: which symbols constitute a winner, the amount winning tickets award, and how many winners of each level there are in the game. The flare also may indicate what the payout percentage is for the entire game, and/or total ticket count, and/or the odds of hitting a winner when the game is new (hit frequency). Furthermore, some organizations mark off winners on the flare as those winners are redeemed. This allows a player to know how many large winners remain in the deal at any given time. Some organizations take the games out of play as soon as all of the "major winners" have been redeemed. "Major winners" are commonly referred to as those which are 50 times bet and above. Thus, played in this way an organization can actually take a loss on a deal if all of the major winners are redeemed before enough tickets have been sold to realize a profit. All of these factors combined contribute to making CGTs one of the most straight forward and fair games imaginable. In order to determine profit and loss on a per deal basis, organizations often maintain separate banks for each deal.

Straight forward as CGTs are, there are also several problems from a regulatory and control perspective.

Problem 1: Insider Information

The clerk or attendant selling tickets and paying off winners has access to the individual deal bank and therefore can determine (through simply counting the cash) when the game bank has more money than the maximum profit of the game provides. This would indicate that the probability of a player winning is absolute if he purchases all of the remaining tickets. It is an excellent time to buy tickets. Knowing this, the clerk informs friends of the state of the bank, often in return for a piece of the winnings.

Problem 2: Inside theft of Tickets

Without counting the tickets remaining unsold in a game the games cannot be accurately audited. Often organizations will offer as many as seven or eight games for sale at one time, in one place, with one clerk on duty. To physically count the tickets remaining in a game, especially when the game has many tickets, can take hours and the accuracy of such counts can be compromised by error. Furthermore, affordable precision scales for weight counting the tickets can be off by as much as 3 to 4% due to variations in paper weight, thickness of glue for lamination, and other factors. Thus, auditing of the games on a nightly basis is virtually cost prohibitive. Clerks or attendants know this and can easily take a small number of tickets home with them each night to open. If they open a winner, they have a friend redeem it. It has become standard for organizations to lose up to 5% of their profit without alarm. They will often blame poor manufacturing, common errors in paying out winners (especially when sales are brisk), and any other possible culprit other than the clerk. Of course the accepted error rate also provides the management or the organization itself with an opportunity to pinch a little money.

Problem 3: Counterfeit Winning Tickets

Rank amateurs in counterfeiting have been involved in assembling or reproducing symbols and tickets to be turned in as counterfeit winners. This has been done by independents and can more easily be done in conspiracy with an attendant who knows that only a few of the games are truly inspected and when they are the inspectors do not take care in examining the redeemed winners for telltale counterfeit traits. Many people who inspect the games and conduct audits are low paid and expected to be able to inspect or audit a given number of games per hour; however, they are unknowledgable about what they should look for and they have no incentive to examine redeemed winners carefully. Real detection of the magnitude of this problem can only be conducted through a careful statistical probability analysis. Such an analysis is beyond the capability of current regulatory agencies.

Problem 4: Bootlegged Games

Bars and organizations can acquire games which have not been registered with the state, play them take the profit and none is the wiser. If the state registration stamp is counterfeited it would be very difficult to catch this activity. The state regulatory authorities do not have the personnel to travel about checking the validity of game registrations. Some organizations have run bootlegged games next to those which are registered and taxed. CGTs are widely available from a number of sources. Some states have tried to cut down on this through the requirement that all games shipped into their states be logged by the manufacturer who in turn sends the state a copy of the log so that it can be cross-checked with what is reported by distributors and finally by the organizations themselves. Theoretically law enforcement personnel would be able to walk into any club or bar and backchain the origin of a game. Often the low funding granted to regulation prevents this theory from being reality. Lack of coordination and will among states to require that all manufacturers keep logs on all games sent anywhere ensure that bootlegged games will continue to be available.

Problem 5: Underreporting Gross Receipts and Profit

Organizations may avoid taxes by overstating the number of unsold tickets in a game, thereby underreporting profit. Incomplete or inaccurate internal control documents could cover this.

GENERAL PROBLEM

States are increasingly viewing charitable gaming as an opportunity to generate extra tax revenue, usually for their general funds. Anti-gaming forces within legislatures find that underfunding regulatory control of charitable gaming is a good political tactic which could lead to problems which can be exploited to do away with gaming. Both of these problems tend to leave regulatory agencies with budgets too small to conduct serious enforcement activities.

To the applicant's knowledge there are no similar computerized games of chance with the features described herein. The games in this invention are written as computer programs and stored on computer memory chips which are encoded by means ensuring that if a game memory chip has been placed in an unlicensed device, the game will not play. This is but one feature intended to overcome the problems discussed previously.

SUMMARY OF THE PRESENT INVENTION

Therefore, it is the object of this invention to provide a computerized apparatus and method for playing a casino game of chance which overcomes the aforesaid problems. In the preferred embodiment, the game correlates most closely to a pull-tab game. The computerized game disclosed herein uniquely presents the player with a choice of games, each having a finite number of winning chances. Some of the desired features ar the display of the percentage of winning chances remaining and the number and amounts of winning chances.

A computerized game is described wherein a player views a video display having a promotional screen. The screen advertises the game and offers either a tutorial program for a nominal fee or the master game screen to begin playing. The tutorial program instructs a player how to play the game in a series of video presentations which simulate a game. The master game screen prompts the player to insert money at the cash acceptor after which he may select a game to play from a plurality of games on display. Each of the displayed games advantageously shows the players the payout percentage and total number of chances, when the game deal is new, the approximate percentage of chances remaining, the number and size of major winning chances remaining, and the cost of a single chance.

When the player selects a particular game to play by touching a sensitive electronic button on the video screen, the computer program is activated, causing a game deal screen to appear on the video display. The player is presented that game's current deal showing the winning symbol combinations, the percentage of the game remaining to be played, the number of major winners remaining, and touch sensitive chances, which when touched display their contents one at a time; or a flip-all button displays all of the offered chances. Also provided are a button to call for a new deal screen (only allowed after at least one chance in a deal has been played), and a button to quit the game and return to the master game or promotional screen. Also displayed on the deal screen is a record of the player's money won which is printed on a paper receipt in order for the player to cash in any net winnings at the casino bank. In one format, nine chances from the current deal of a selected game appear on each deal screen. A random number generator program determines the locations of nine chances (tickets) in a deal and they are displayed on a deal screen in such a manner that any unused chance is returned to the pool of unused chances in that particular deal. If less than nine unused chances are available, those chances will appear on the video along with a statement reading "last available chances in this deal."

The player may select by placing a finger on a particular touch sensitive chance button, and as the player does so, a credit is subtracted, and the chance is electronically displayed (flipped over) to reveal the three symbols it comprises. If the three symbols match those shown on the top of the screen as a winner, the appropriate amount of credits will be added and displayed on the video screen along with a corresponding sound and symbol graphic explosion.

If the player selects the flip-all button, nine credits are deducted from the credit display; and all nine chances are electronically flipped over. Any winning combination of three symbols on any one chance results in the increase of cash credits with an appropriate sound and symbol graphic explosion.

After viewing the results of flipping a chance, the player may select a new deal screen or quit. When a player chooses to quit, all of the remaining credits are indicated on a printed receipt which shows all wins for each game played, date and time of receipt, license number of the device, internal control validation numbers and dollar amount of the cash credit.

In addition, each game has as many as 50 deals stored in memory on a computer chip module. A record is kept of all plays for that module, including dates of major wins and their amounts, date of a deal first being played, date of a deal retirement, and number of chance tickets unsold at the time of retirement, in order for the regulatory agency and casino operators to evaluate the fairness and profitability of the games and, in particular, the odds. Such a record is useful in analyzing the feasibility of special features, such as the major win rule or the last sale feature. The major win rule is the playing of a deal only so long as at least one of the higher level winners (equal or greater than 50 times the price of a single chance) remains available to be won within a deal. After all of the higher level winners have been redeemed, the deal is retired from play and the next deal for that game (if any remain) is put in place. A deal can actually lose money if the random placement of winners within a deal leads to the winners being selected by the players prior to enough losers being played to cover the profit of the game. The size of a major win may vary from one bet denomination to another. For instance, games with bet sizes of twenty-five cents may more commonly have major win definitions equal to or greater than 40 times bet or $10.00.

As a further unique and advantageous feature, a last sale option is provided. By this feature, the very last chance available awards the player a prize equal to or higher than a major win if the games are played completely through the last chance in each deal. This feature provides an incentive for the player to finish a game and it means that all of the deals in a particular game could have the same actual payout and profit. The player can ascertain whether the last chance is worth the cost by viewing both the information on the game deal screen and the master game screen.

Another feature is the computerized record keeping of at least the following deal information: 1) the total number of chances actually played; 2) the total amount of actual winning chances redeemed; 3) the total value of unsold chances within the deal; 4) the value of unredeemed winners; 5) the actual profit for the particular deal; 6) the date the deal was put in play and the date the deal was retired; and 7) the serial number of the particular deal. Every deal in the game is electronically audited with game I.D. information and client I.D. information. Deal Audit Information may be printed on a monthly, weekly or daily basis, and/or when all deals within a game are totally exhausted. The information may also be collected for a device by a regulatory authority through telephone modem connected to a centralized regulatory computer.

The foregoing objects, features, and advantages become apparent from the following drawings and detailed descriptions of certain embodiments of this invention.

DETAILED DESCRIPTION OF THE PREFERRED EMBODIMENT

An exemplary embodiment of the invention is disclosed herein; however it is to be understood that it is not limiting, but merely a basis for the claims and for teaching one skilled in the art how to employ the invention in any appropriate way. The invention could be embodied in a variety of commercially available computers and its software could be written in any compatible programming language.

Figure 1A:
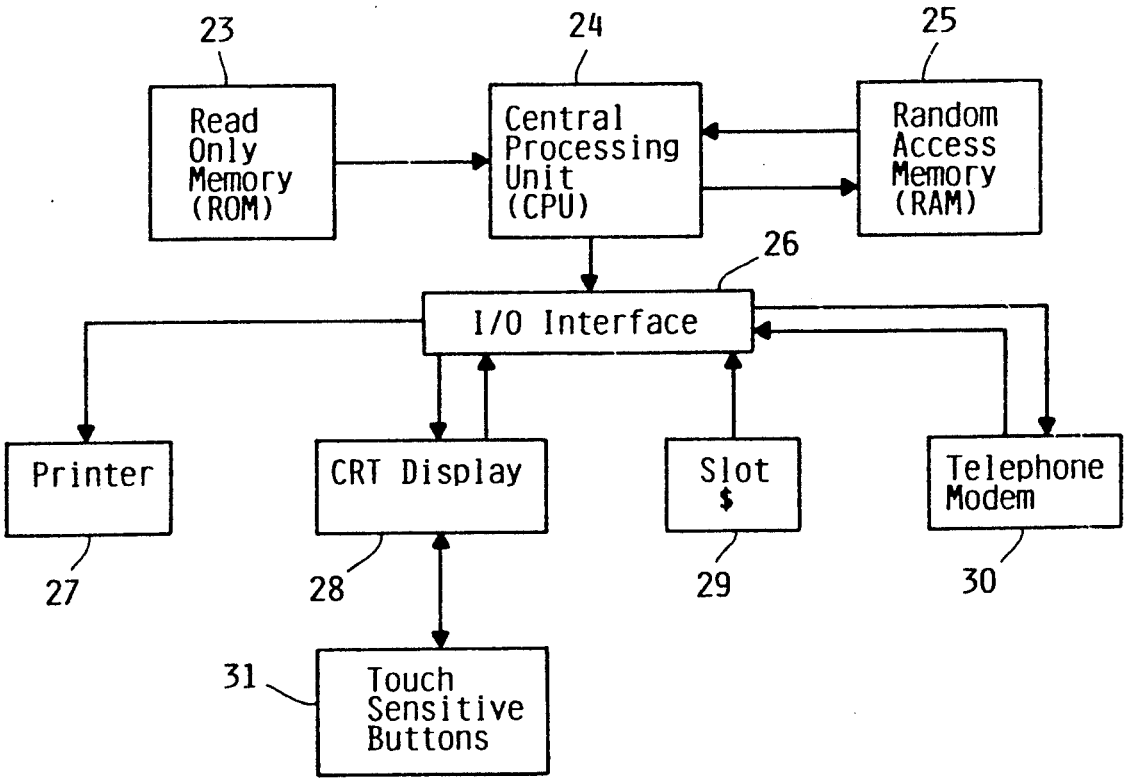
FIG. 1A is a simplified block diagram of the principal components of the hardware configuration employed in the present invention.

This embodiment utilizes a hardware configuration as described in FIG. 1A wherein a computer comprises a central processing unit (CPU) 24, a read only memory (ROM) or a programmable read only memory (PROM) 23, a random access memory (RAM) 25, and an input-/output interface 26 connected to a cathode ray tube (CRT) video display 28 having touch sensitive buttons or areas 31. Considered as a whole, FIG. 1A comprises the hardware of the computerized gaming device of the invention.

Figure 4:
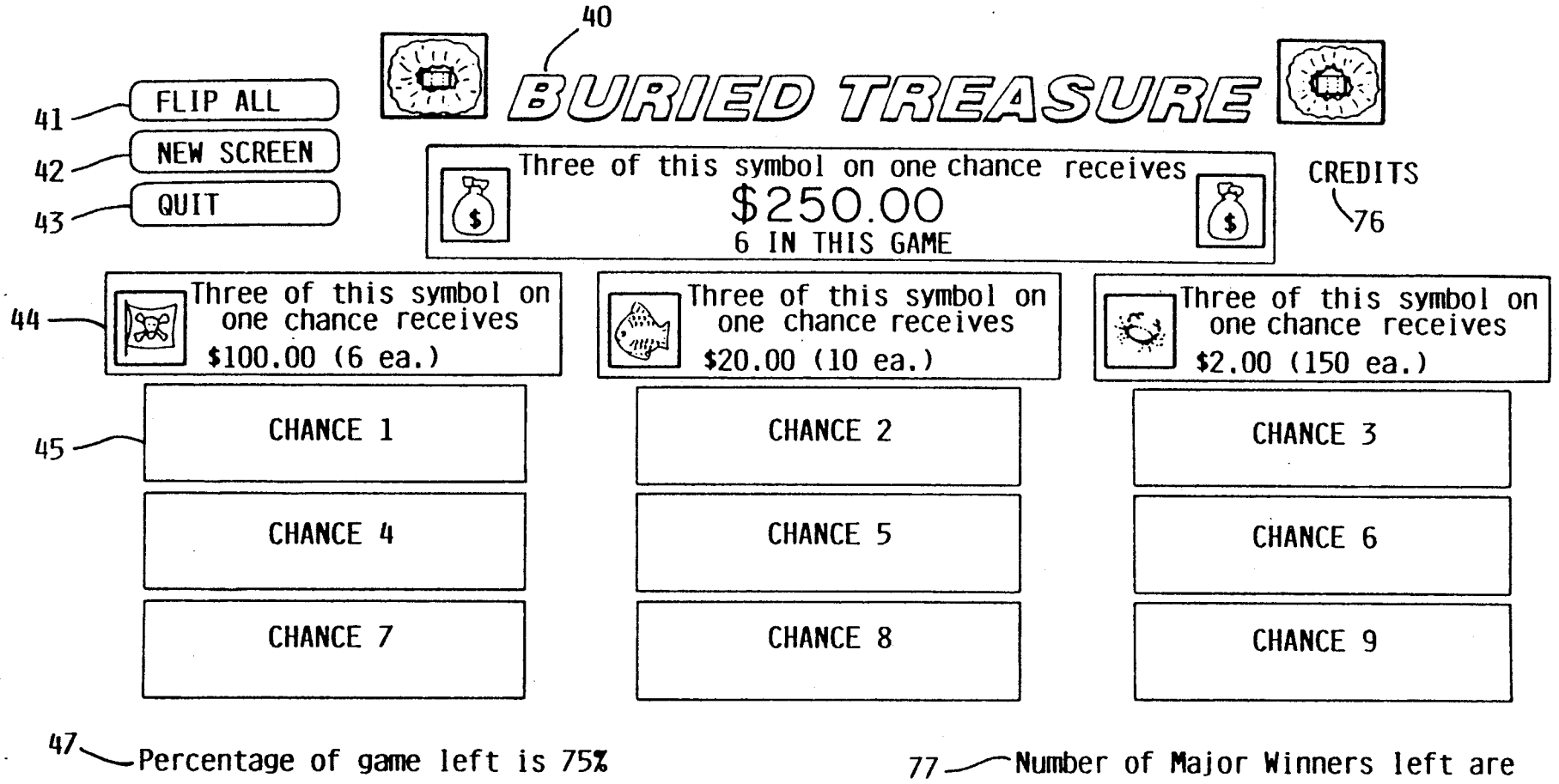
FIG. 4 is a view of a particular game/deal video screen display offering the player the current tickets, alternatives and winning chance information.
Figure 5A:
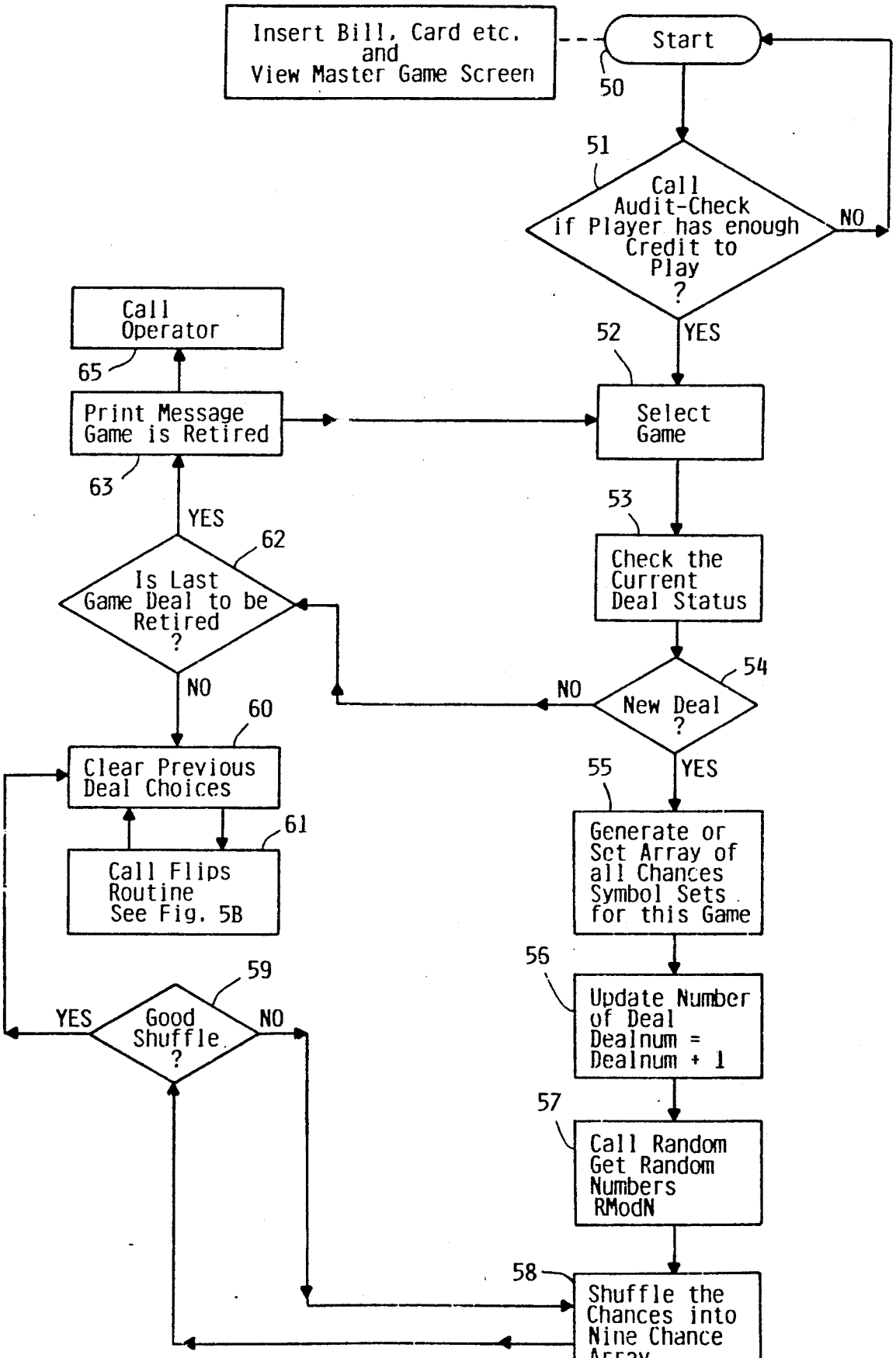
FIG. 5A is a flow chart representing the principal steps employed by the games software programs.
Figure 5B:
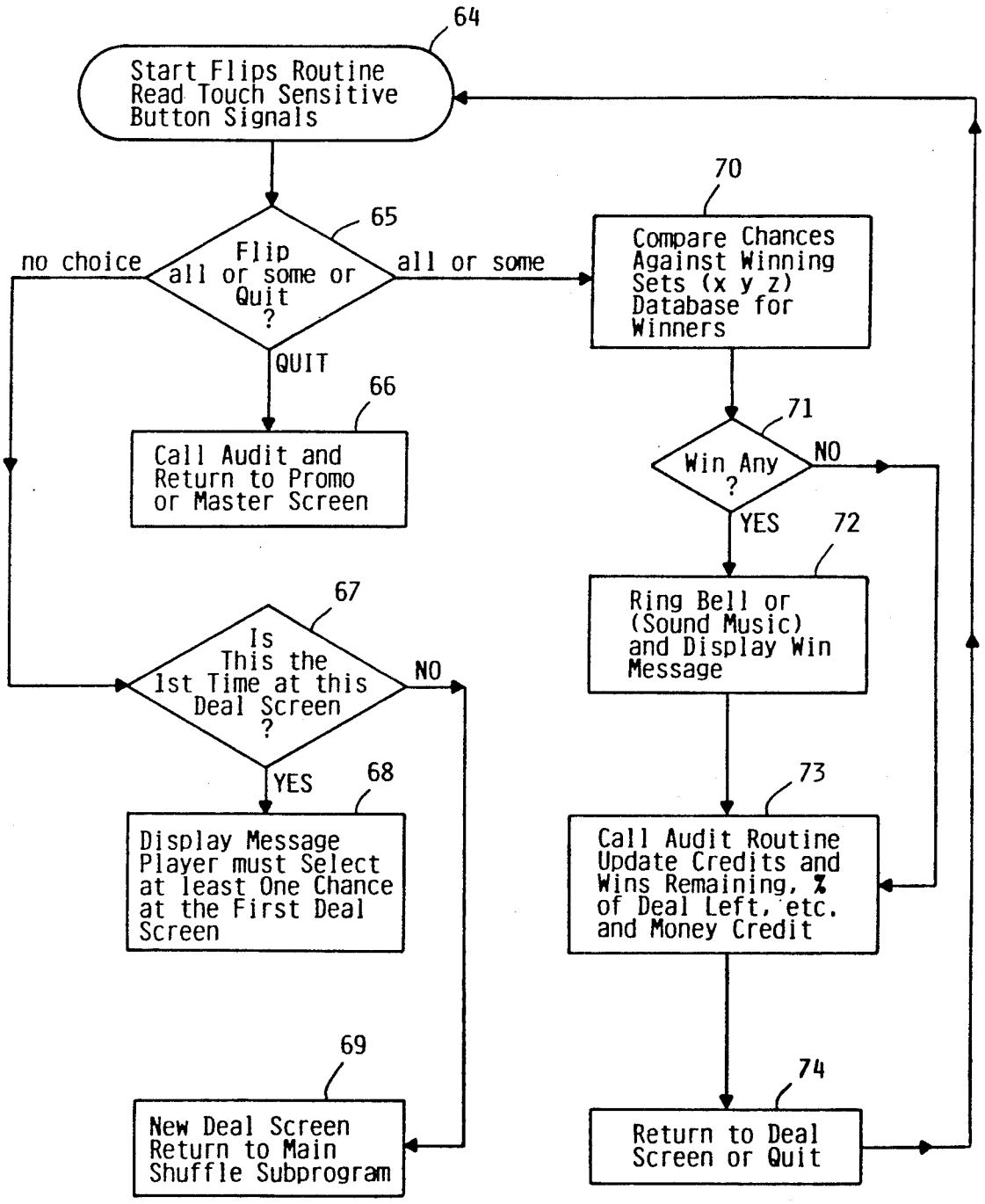
FIG. 5B is a flow chart exemplifying the program in FIG. 5A that actually displays the player's choices and determines whether there are any winnings.

In order to operate the computer in FIG. 1A, the methods described in the computer program flowcharts of FIGS. 5A and 5B are employed. Those programs comprise a method of playing the games of the invention. In the preferred embodiment, the games resemble pull-tab casino games 40 as described in FIGS. 2, 3 and 4.

Figure 2:
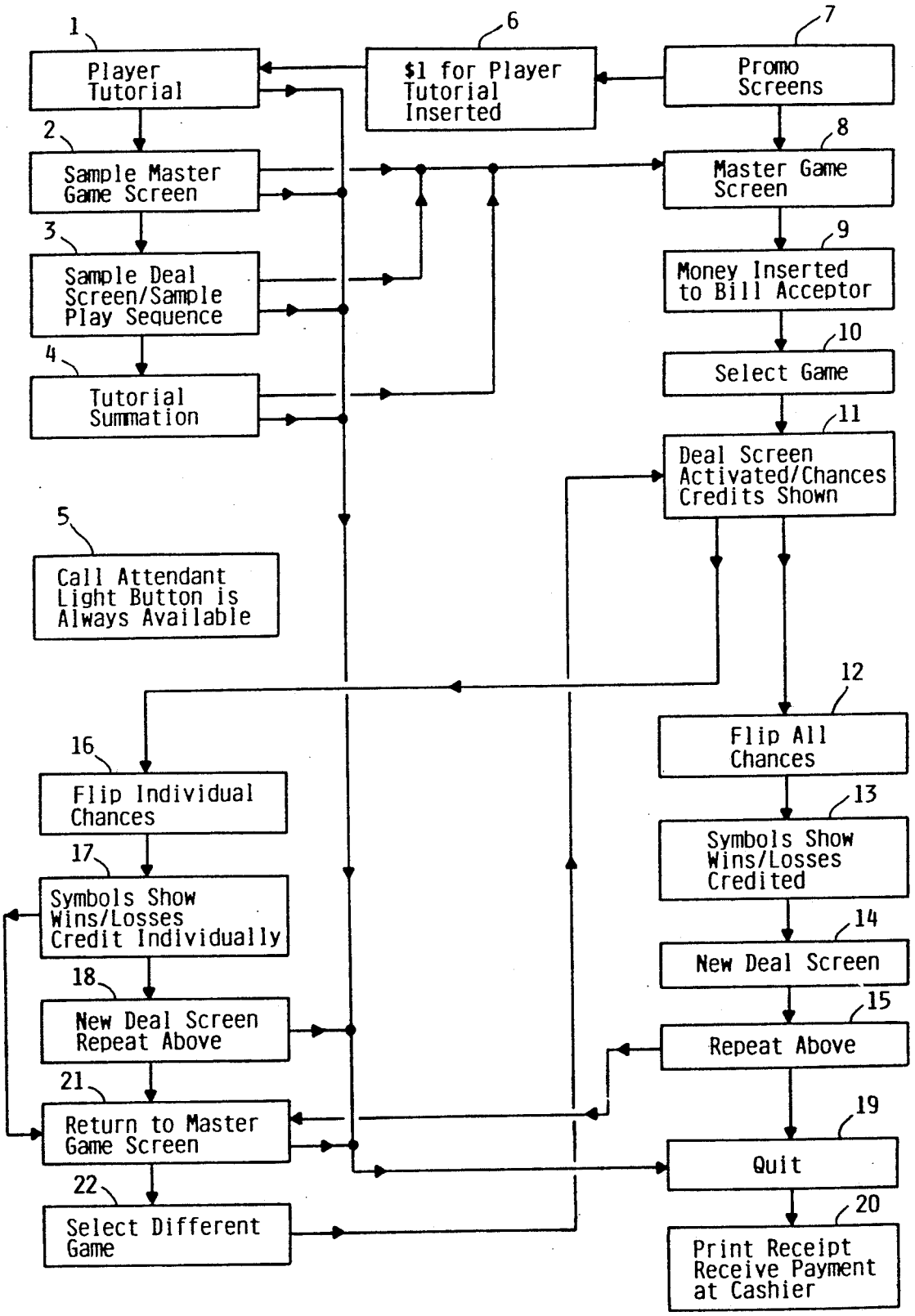
FIG. 2 is a block diagram of the steps a player follows to operate the present invention and play a game.
Figure 3:
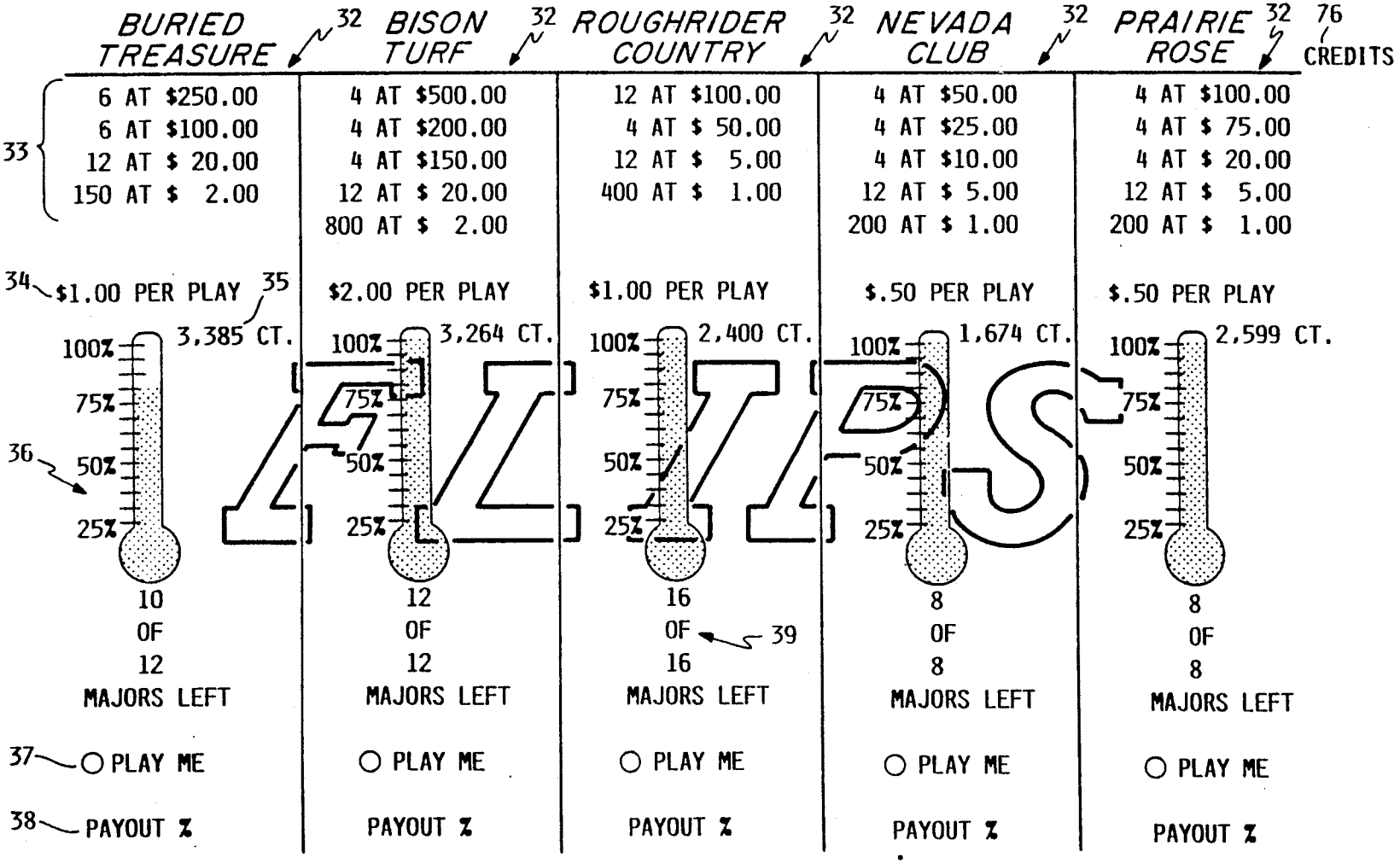
FIG. 3 is a view of a master game video screen display offering the player the game selections and deal information.

FIG. 2 is a block diagram describing the various steps a player follows to play a game, along with an optional tutorial course initiated by touching player tutorial button 1. The video screen 28 alternates the display of two promotional screens 7 and a master game screen 8 as shown in FIG. 3 until a player activates the device by inserting money into the money acceptor 9. Both of the promotional screens 7 also offer the player the opportunity to select the tutorial program 1 which instructs him (her) how to play and what to look for in the games.

In any embodiment, the tutorial program 1 is optional. Should a player choose the tutorial, he (she) is prompted to insert a dollar, for instance, in the slot 29 (FIG. 1A), as indicated by step 6 in FIG. 2. However, the player may insert a five, ten or twenty dollar bill with the credit for all but the dollar being given and displayed on the video screen 28. From each tutorial screen 1 the player is able to access the master game screen 8 as an escape from the tutorial. The tutorial is a series of screens wherein the first screen 1 informs the player of the finite character of the games, how the deals retire when the last major winner has been redeemed, and when and how the casino attendant may be called. The second tutorial screen 2 is a sample master game screen with overlays and arrows pointing out the specific features of each game that the player should look at when choosing a particular screen. The third tutorial screen 3 is a sample deal screen (an offering) which uses overlays and arrows to show a player a particular sample deal and what to expect. It allows the player to choose (electronically "flip") sample chances (as shown at 45, FIG. 4) to see which symbols comprise them. The fourth tutorial screen 4 is a summation and an advertisement of the games inviting the player to return to the master game screen 8, and start playing the game.

The master game screen 8 displays five different games and prompts the player to select (select game 10) one by touching a "play me" area 37 as shown in FIG. 3. The master game screen includes: the names of the games 32, cost per chance 34, number of chances when a deal is new 35, chance meter 36 showing roughly the percentage of chances which remain in a deal, the payout percentage 38 when the deal is new, the number (and size) of winners 33 when the deal is new, and the number of major winners 39, 77 remaining in the deal at present.

If a player selects a game without having deposited money or with zero credits, a message appears asking the player to please place money in the money acceptor 9 in order to go to a deal (offering) screen shown in FIG. 4. Anytime money is deposited it is recorded on two credit meters 76 (FIG. 4).

Once a game is called for, the random number generator will select the order in which all of the chances in a particular deal will be called up. The random number generator program 57 (FIG. 5A) will return a random number R 57 to be inputed to the shuffle program 58 which in turn will randomly select symbol sets for each of the next nine chances 45 of a particular deal to be displayed on the deal screen shown in FIG. 4. Since there are many ways in which a computer program can be written to select symbol sets and chance locations, the following FORTRAN code is but an example of how to accomplish the same:

```
                    SUBROUTINE RANDOM (R,N)
C
C  WHEREIN N IS THE CURRENT DEAL SIZE INPUT
C            R IS THE RANDOM NUMBER TO BE RETURNED TO THE
C            CALLING PROGRAM
C
   COMMON RTIME/TIME
C
C  WHERE RTIME IS THE VARIABLE EQUATED TO THE CURRENT OR
C  ELAPSED TIME AS IT IS CLOCKED BY THE COMPUTER SYSTEM.
C  THEREFORE ITS UNIT OF MEASURE IS DEPENDENT ON THE
C  PARTICULAR COMPUTER MANUFACTURER'S HARDWARE AND UTILITY
C  SOFTWARE
C
C  THIS SUBROUTINE COMPUTES A RANDOM NUMBER FROM 1 TO N AS A
C  FUNCTION OF THE CURRENT TIME AS FOLLOWS:
   N = N + 1
   R = INT (RTIME * 1000000000)
   R = MOD (R,N)
   IF R.E0.0 R = 1
   N = N - 1
C
C
C  NOTE: R = RTIME * 10^9 IS JUST ONE WAY TO ENSURE A
C  POTENTIALLY LARGE DIFFERENCE IN THE RANDOM NUMBERS
C  GENERATED BY RAPID SUCCESSIVE CALLS TO THIS SUBROUTINE.
C  THE NUMBER 10^9 IS BUT A SUGGESTED MULTIPLIER WHICH CAN BE
C  CHANGED DEPENDING ON ACTUAL RESULTS DURING TESTING
   RETURN
   END
```

Table 1 is an example of a deal structure wherein four different symbols, represented by letters or characters, are selected three at a time to generate twelve different combinations comprising the chances as previously discussed.

TABLE 1

EXAMPLE OF A DEAL STRUCTURE

TOTAL NUMBER OF CHANCES = 1,620
PRICE PER CHANCE = $1.00
GROSS RECEIPTS POSSIBLE = $1,670.00
ALLOWABLE SYMBOLS

| F | P | C | $ |
|---|---|---|---|
| FISH | PIRATE | CRAB | MONEY |

| SET | NUMBER OF CHANCES | COMBINATION OF SYMBOLS | MONEY WON EACH CHANCE | MAXIMUM WINNINGS |
|---|---|---|---|---|
| 1 | 4 | $ $ $ | $100.00 | $400.00 |
| 2 | 4 | P P P | $75.00 | $300.00 |
| 3 | 4 | C C C | $50.00 | $200.00 |
| 4 | 12 | F F F | $5.00 | $60.00 |
| 5 | 200 | $ $ F | $2.00 | $400.00 |
| 6 | 296 | F P C | 0 | 0 |
| 7 | 200 | F F P | 0 | 0 |
| 8 | 200 | F F C | 0 | 0 |
| 9 | 200 | F P P | 0 | 0 |
| 10 | 200 | C P P | 0 | 0 |
| 11 | 200 | C C F | 0 | 0 |
| 12 | 200 | P C P | 0 | 0 |
| TOTAL POSSIBLE PAYOUT (WINS) | | | | $1,360.00 |
| IDEAL PROFIT | | | | $310.00 |
| % PROFIT | | | | 18.56% |

Obviously, four symbols taken three at a time could be combined in 64 different ways. However, for profitability and efficiency reasons, the games in this invention are designed in a predetermined manner as in Table 1. It is to be noted that there may be symbols used which are not winners.

Letting Table 1 represent the deal structure for each deal of a particular game, one way to randomly generate combinations of symbols comprising the array of nine chances 45 to be displayed on the deal screen in FIG. 4 is described in the following FORTRAN code:

```
      MYCOM.CMM
C
C     THIS CODE SETS COMMON ADDRESSES FOR VARIABLES USED IN MORE
C     THAN ONE PROGRAM OR SUBROUTINE
C
      INTEGER*4 DEALNUM, TS, NEXT1, QUIT1, FLIPALL, MWIN,
     1FSET, LWIN, X.LFLAG
C
      CHARACTER*3 GAME1, GAME2, GAME3, GAME4, GAME5, CHANCE,
     1SET
C
C
      REAL PR, CREDIT, DPR
C
C
      COMMON/MYCOM/GAME1 (1620), GAME2 (3264), GAME3 (2400),
     1GAME4 (3385), GAME5 (2599), DEALNUM (5), CHANCE (9), TS
```

-continued

```
      1(9), X, NEXT1, QUIT1, FLIPALL, SET (12), FSET (500), DPR
      1(5), MWIN (5), CREDIT, LWIN (12), LFLAG, SET1 (12), SET2
      1(12), SET3 (12), SET4 (12), SET5 (12), X1, X2, X3, X4, X5,
      1PR
C
C     ADDITIONAL VARIABLES CAN BE ADDED AS NEEDED FOR OTHER
C     SUBROUTINES SUCH AS THE AUDIT PROGRAM
      SUBROUTINE SHUFFLE (GAMENO)
      INTEGER*4 N, R, X, DEALNUM(5), FSET(500)
      CHARACTER*3 SET(X), GAME1(1620), GAME2(3264),
      1GAME3(2400), GAME4(3385), GAME5(2599), CHANCE(9), SET(9),
      1GAME(N)
      INCLUDE 'MYCOM.CMM/NO LIST'
C
C
C
C
C     THIS SUBROUTINE RANDOMLY SELECTS CHANCES FROM A GAME'S
C     DEAL DATABASE STORED IN A COMMON MEMORY TO THE MAIN
C     PROGRAM AND OTHER SUBROUTINES AND PLACES THEM INTO THE
C     DEAL SCREEN POSITIONS
C
C     WHERE N =    DEAL SIZE
C           X =    NUMBER OF DIFFERENT CHANCE
C                  (SYMBOL COMBINATION) SETS ≦ 12
C     SET(X) =     ARRAY DEFINING THE DIFFERENT SETS OF SYMBOLS
C                  COMPRISING THE CHANCES IN A PARTICULAR DEAL
C     FSET(X) =    ARRAY OF SIZES (NUMBER OF CHANCES) OF EACH
C                  SET(X); IT IS DIMINISHED BY ONE EACH TIME A
C                  CHANCE FROM SET(X) IS CHOSEN BY A PLAYER
C     GAME1        ARRAYS CONTAINING THE DEAL
C       TO =       STRUCTURE FOR
C     GAME5        EACH GAME
C
C     GAMENO =     A NUMBER FROM 1 TO 5, IT IS THE PARTICULAR GAME
C                  SELECTED BY THE PLAYER
C
      NTICKET =    0
C
C     INITIALIZE NUMBER OF CHANCES TO BE SELECTED FOR A NEW DEAL
C     SCREEN
C
      GO TO GAMENO
C
C     THE FOLLOWING SETS THE CURRENT DEAL DATABASE OF A CHOSEN
C     GAME
C
  1   N = 1620
      X = X1
      DO 8 J = 1,X
         SET (J) = SET1(J)
  8   CONTINUE
      DO 7 I = 1,N
         GAME(I) = GAME1(I)
  7   CONTINUE
      GO TO 6
C
  2   N = 3264
      X = X2
      DO 10 J = 1,X
         SET (J) = SET2(J)
  10  CONTINUE
      DO 9 I = 1,N
         GAME(I) = GAME2(I)
  9   CONTINUE
      GO TO 6
C
  3   N = 2400
      X = X3
      DO 12 J = 1,X
         SET (J) = SET3(J)
  12  CONTINUE
      DO 11 I = 1,N
         GAME(I) = GAME3(I)
  11  CONTINUE
      GO TO 6
C
  4   N = 3385
      X = X4
      DO 14 J = 1,X
         SET(J) = SET4(J)
  14  CONTINUE
```

-continued

```
      DO 13 I = 1,N
         GAME(I) = GAME4(I)
 13   CONTINUE
      GO TO 6
C
 5    N = 2599
      X = X5
      DO 16 J = 1,X
         SET(J) = SET5(J)
 16   CONTINUE
      DO 15 I = 1,N
      GAME(I) = GAME5(I)
 15   CONTINUE
C
 6    DO 20 L = 1,9
         CALL RANDOM (R,N)
            DO 30 I = 1,X
               TCHECK = GAME(R)
               IF TCHECK .EQ SET(I) .AND. FSET(I).NE.O
               TICKET(L) = SET(I) .AND. NCHANCE = NCHANCE+1                !60
C
C     THE ABOVE RANDOMLY DETERMINES WHICH CHANCES TO DISPLAY AS
C     THE 9 CHANCES ON THE DEAL SCREEN
 30          CONTINUE
 20   CONTINUE
      IF NCHANCE .EQ.9 GOTO 200
         ELSE DEALNUM(GAMENO) = DEALNUM(GAMENO)+1                          !56
      CALL AUDIT
      NCHANCE = 0                                                          !59
         GO TO 6
C     DEAL RETIRED, DO ACCOUNTING AND INITIALIZE FSET(X) AND
      RETRY FOR A GOOD DEAL
 200  RETURN
      END
```

A program as described herein permits carrying out the game steps shown in FIG. 2. Once a particular game is selected by pressing one of the play me buttons 34 shown in FIG. 3, a deal display will appear on the video screen (step 11, FIG. 2), an example of which is shown in FIG. 4 as Buried Treasure.

A player then may select any one chance at a time by placing his finger on a particular chance among those displayed at 45, FIG. 4. As the player does so, a credit is subtracted, and a chance is electronically flipped over (16) to reveal the three symbols it contains (17). If the three symbols match those shown on the top of the screen as a winner, the appropriate amount of credits will be added on the credit meter—individually and quickly with a corresponding sound.

A player must select at least one chance from each screen offered. Afterwards, he has the opportunity to select a new Deal Screen 18 (touch button 42, FIG. 4) with a new offering of nine chances. Those not chosen off of the previous screen go to the back of the deal and shall reappear only after the original order has been exhausted. A player may wish to flip all of the nine chances on the screen at once. Should this be desired, he merely place his finger on the "Flip All" button 41 (Step 12, FIG. 2) on the screen. Nine credits shall be deducted, and all of the chances shall be electronically flipped at once. Any winning combination of three symbols on one or more chances shall result in the increase of credits individually, quickly and with appropriate sound, as indicated at step 13 in FIG. 2. When this "Flip All" is used, we anticipate the player desired speed, and therefore for a brief moment after all of the credits have been accumulated from the previous win the next Deal Screen shall appear (14). Thereafter the player may repeat the "Flip All" sequence (15) or return to the Master Game Screen (21).

A player may choose to return to the Master Game Screen as shown in FIG. 3 (21) from any subsequent Deal Screen without having to flip a chance. A player may go to the Master Game Screen after selecting only one chance in the "Flip Individual Chances" method or track. When a player returns to the Master Game Screen, his credits shall go with him and be debited from the game meter they exited. Upon returning to the Master Game Screen, the player selects a different game (22), and the steps commencing with step 11 are repeated.

A player may quit from either "Flip Individual Chances" (16), "Flip All Tickets" (12), or the "Return to Master Game Screen Mode" (21), or any tutorial. When a player chooses to quit by touching button 43 on the screen (19), all of the remaining credits are indicated on a printed receipt (20) which shows all major wins for each game played, date and time of receipt, license number of device, two internal control validation numbers, Dollar amount in both numerical and written form.

The software provided carries out logic steps 50-65 illustrated in FIG. 5A in order for game play to progress through the game steps illustrated in FIG. 2. Start step 50 is initiated in response to a player putting a bill into the bill acceptor (step 9, FIG. 2). The audit step 51 then operates automatically to determine if a player has enough credits to play. The main program calls various subroutines to determine which deal of a game is available—either a current deal 53 with chances remaining or a new deal 54, or if none 62 are available, a message 63 is displayed on the video screen that the particular game has been retired. If a game is retired, the player can choose another game 52 from the master game screen, or call the operator 65 or quit 5, 19. The main program also responds to the player's choices, provides for the deal structure initialization 55 within each game and monitors the game playing. After the deal number is updated in step 56, the random number generator calls up a number of chances in step 57. The subroutine SHUFFLE 58 described above with respect to Table 1 is called from a main program which will monitor the game choices selected by the player at the master game screen and shuffle the chances into a nine ticket array.

There are many ways in which software can be written to accomplish the same result. The following FORTRAN code is but one example of how such a main program can be written:

```
      PROGRAM MAIN
C
      INTEGER*4 N, X, DEACNUM, FSET, LFLAG, TS
C
C
      CHARACTER*3 GAME1, GAME2, GAME3, GAME4, GAME5, GAME, SET,
     1CHANCE
C
C
      DIMENSION GAME(5000)
C
C     THIS IS THE MAIN PROGRAM WHICH MONITORS GAME SELECTIONS ON
      THE MASTER GAME SCREEN AND CALLS THE SUBROUTINES TO
      PROCESS GAME CHOICES AS NEEDED
C
C
      INCLUDE 'MYCOM.CMM/NO LIST'
C
      CALL AUDIT                                                        !51
C     INITIALIZE AND UPDATE THE GAME RECORDS AND CHECK THE              !50
C     PLAYER'S CREDIT - IF NOT ENOUGH CREDIT STOP THE PLAY
C     AND NOTIFY THE PLAYER
C
      READ (UNITM,1000) GAMENO                                          !10
C     READ GAME NUMBER SELECTED ON MASTER SCREEN
C
 1000 FORMAT (I)
C
      IF LFLAG .EQ.1 GO TO 100                                          !11
C
C     IF LFLAG = 0, A NEW DEAL OF A DIFFERENT GAME IS STARTED
C
      GO TO GAMENO
C
C
  1   READ (PROMU, 1010) X1, SET1(I) I = 1,X1
C             PROMU IS THE LOGICAL UNIT FOR PROM
      READ (PROMU, 1001) GAME1(I) I = 1,1620
         GOTO 110
  2   READ (PROMU, 1010) X2 SET2(I) I = 1,X2
      READ (PROMU, 1002) GAME2(I) I = 1, 3264
         GOTO 110
  3   READ (PROMU, 1010) X3, SET3(I) I = 1,X3
      READ (PROMU, 1003) GAME3(I) I = 1, 2400
         GOTO 110
  4   READ (PROMU, 1010) X4, SET4(I) I = 1,X4
      READ (PROMU, 1004) GAME4(I) I = 1, 3385
         GOTO 110
  5   READ (PROMU, 1010) X5, SET5(I) I = 1,X5
      READ (PROMU, 1005) GAME5(I) I = 1, 2599
         GOTO 110
C
 1010 FORMAT (I4, 12A3)
C     DATA MUST BE FORMATTED THE SAME WAY ON THE PROM
 1001 FORMAT (1620 A3)
 1002 FORMAT (3264 A3)
 1003 FORMAT (2400 A3)
 1004 FORMAT (3385 A3)
 1005 FORMAT (2599 A3)
C
C     THE ABOVE CODE READS THE VARIOUS GAME DEAL STRUCTURES AND
      CORRESPONDING ODDS PER COMBINATION OF SYMBOL SETS INTO
      THE CPU FROM PROM
C
 110  DEALNUM(GAMENO) = DEALNUM(GAMENO) + 1
      IF DEALNUM = 51 GOTO 2000
C             IF DEALNUM = 51, THEN ALL DEALS IN THIS GAME ARE
C             RETIRED
 100  CALL SHUFFLE (GAMENO)
      CALL FLIPS                                                        !61
         GOTO 2010
 2000 WRITE (UNITM, 1020)
 1020 FORMAT (1X, 'ALL DEALS IN THIS GAME ARE RETIRED, '/'              !63
      CHOOSE QUIT TO RETURN TO THE MASTER GAME SCREEN TO CHOOSE
      ANOTHER GAME OR CALL THE OPERATOR')                               !65
```

-continued

```
C       PAUSE UNTIL PLAYER MAKES CHOICE                                  !21, 22
  2010  STOP
        END
```

The subroutine AUDIT 51, 66 records information about each deal played in each game. It keeps track of the cash credits, the number of chances actually played, the total amount of winning chances remaining to be played in a deal and potentially anything that can be accounted for as desired. A credit transfer feature automatically transfers a player's credits when the player switches from one game to another. Recording this information permits tracking player game preferences through credit sourcing.

There are many unique ways such audit program may be written and it is obvious that a person trained in the art of programming would be able to readily write such a program given the input and output specifications.

In the main program described above, one way to determine whether a game is new or whether a deal within a game is new, is by using the variable LFLAG to call subroutine AUDIT, which in turn initializes a flag for each game and for each deal within it in order to tell the main program which data structure to work with when it calls the subroutine FLIPS 61 (FIG. 5A) to reveal the player's choices. Subroutine FLIPS 64 (FIG. 5B) is but one way to respond to and display a player's chances on the deal screen. The logic steps 64 through 74 shown in FIG. 5B may be incorporated in a program as follows, the reference numerals at the right hand margin indicating the steps as shown in FIGS. 2, 4, and 5B.

```
        SUBROUTINE FLIPS
C
        CHARACTER*3 SET(12), LCHANCE(9)
C
        INTEGER*4 DEALNUM(5), NEXT1, QUIT1, FLIPALL
        LOGICAL LTOUCH
C
        DIMENSION TS(9), CHANCE(9), LWIN(9)
        INCLUDE 'MYCOM.CMM/NO LIST'
C
C
  2000  FORMAT (L)
  1     READ (UNITM, 2000) LTOUCH                                        !64
        IF LTOUCH .FALSE. THEN
            PAUSE 'TOUCH ME IF YOU HAVE FINISHED YOUR CHANCE             !48
        1SELECTIONS'
        END IF
C
C       THIS SUBROUTINE PROCESSES THE TOUCH SENSITIVE CHANCES
C       (BUTTONS) AS THEY ARE PRESSED BY THE PLAYER ON THE DEAL
C       SCREEN IN ORDER TO DISPLAY CHANCE CHOICES AND PERFORM THE
C       GAMES. ALL TOUCH BUTTONS ARE RESET TO ZERO OR .FALSE.
C       WHEN SELECTIONS ARE FINISHED IN PREPARATION FOR A NEW DEAL
C       SCREEN
C
        IF QUIT1 .EQ. 1 CALL QUIT                                        !19, 43
        IF NEXT1 .EQ. 1 GO TO 50                                         !42
        IF FLIPALL .EQ. 0 GO TO 20                                       !12, 41
            ELSE DO 10 I = 1,9
                TS(I) = 1                                                !13, 16
  10    CONTINUE
  20    DO 30 J = 1,9
            IF TS(J) .EQ. 0 GO TO 30                                     !70
                DO 25 I = 1,5
C
C       IS THERE A WINNER? COMPARE SELECTION AGAINST WINNING
C       SETS                                                             !71
        IF CHANCE(J) .EQ. SET(I) THEN
            CALL WINNER                                                  !72
            END IF
  25    CONTINUE
C       DECREASE NUMBER OF CHANCES IN THIS SET BY ONE
        DO 27 I = 1,X
            IF CHANCE(J) .EQ. SET(I) THEN
            LWIN(I) = 1 .AND. FSET(I) = FSET(I) - 1
            END IF
  27    CONTINUE
  30    CONTINUE
        GO TO 55
  50    IF NEXT1 .EQ. 1 .AND. PR .LT. 100 THEN                           !14, 15, 47
            CALL NEXT !PR IS PERCENTAGE OF DEAL REMAINING
        ELSE                                                             !67
        WRITE (UNITM,2020)
        END IF
  2020  FORMAT ('YOU MUST SELECT AT LEAST ONE CHANCE IN THIS             !68
        DEAL')
C       GO TO 1                                                          !15, 18
  55    DO 60 I = 1,9
```

-continued

```
        IF TS(I) .EQ. 1 THEN
        WRITE (UNITM, 3000) CHANCE(I)                    !16, 17
60  CONTINUE
3000 FORMAT (A3)
    CALL AUDIT                                           !66
C   RESET BUTTONS AND VARIABLES TO ZERO OR .FALSE.
    DO 75 I =    1,9
    LWIN(I) =    0
    TS(I) =      0
75  CONTINUE
        FLIPALL =  0
        NEXT1 =    0
        QUIT1 =    0
    RETURN                                               !69, 74
    END
```

A subroutine WINNER 71, 72 called by the subroutine FLIPS is a means to notify the winner immediately by emitting sound and/or flashing lights and/or graphic simple explosion on the video display. The FLIPS 61, 64 subroutine also calls the subroutine AUDIT 66, 73 to update the accounting records for the games and to display current values of the player's cash credit, wins, percentage of each deal remaining 47 in each game and number of major wins remaining 77 and other items as appear to be appropriate.

There are other ways in which this invention may be embodied in software and hardware. The preferred way is the most efficient one. Time is of the essence while playing a game in this invention. Therefore, it is important to create software programs that respond quickly; otherwise players will become bored and disinterested with the game. The examples of computer programs described herein are written with speed of operation in mind by performing search operations on the databases located in the central processing unit rather than on another device. Furthermore, the use of the random number generator and shuffle subroutines provide a quick way to rearrange the array of chances to be displayed rather than actually moving the location of each chance within a deal in a particular database. The latter could involve thousands of computer move operations and take much longer to do.

The particular video screen design and method of displaying pictures and words can be produced in many ways also. There are many commercial video screens and accompanying computer software to display messages both visually and audibly. They deserve mention here even though they do not comprise the invention except when viewed as a whole. Likewise, the means of employing touch sensitive electronic buttons (or light sensitive buttons) by which the player can signal the computer of his/her choices is also a commercial product readily available in the market as needed to suit specific applications.

Lastly, the particular software described herein is compiled into an object code form and encoded into electronic circuitry on semiconductor chips within a programmable read only memory (PROM or ROM) 23. It is the object code of the main program and subroutines along with the deal structure of each game that is down-loaded to the central processing unit 24 at runtime. The audit subroutine records can be stored on the random access memory 25 for updating the video display and final printout 20, 27. The audit subroutine handles a variety of accounting tasks including initializing and updating flags to signal a particular deal's status. One important function of the audit subroutine is to check the choices of winning tickets 44 in each symbol set and update said flags via a program instruction (e.g. COMMON STATEMENT) in order that a deal (or game) be properly retired when appropriate.

The software example discussed herein can be readily adapted to a variety of computers and peripheral devices such as printers and video displays and their respective operating systems.

Since the PROM or ROM unit 23 can be interchanged and uniquely designed by the manufacturer, a unique feature of this invention is that the games deal structures, odds and operational software can be modified by the manufacturer to keep the games interesting. This feature provides the flexibility desired by casino operators and regulatory agencies in order to promote both fairness and profitability.

Finally, the PROM or ROM 23 and computer hardware are encoded with licensing information in such a manner that the software can only be operated in specific devices and/or only enabled by a person having knowledge of how to satisfy the code requirements. Such means and method is strictly hardware/software dependent or subject to manual input of a license code on a computer keyboard. Such means and methods are easily created by one trained in the art of designing computer security. One example of such encoding is the creation of a variable named LICENSE which is inputed on the PROM 23 and RAM 25 modules and at a read only location on the CPU 24. A software test procedure called at runtime reads the variable LICENSE at each of the three locations, compares them, and if they don't compare the computer is interrupted. Likewise the software test program can prompt an operator to input the correct licensing code at a keyboard in order to ensure the lawful operation of the games.

Another method of designing computer programs of chance is to set up each deal in each game on the ROM 23 chip module such that the chance symbol set combinations are randomly located. Thus the deal databases are predetermined in a random manner and need only be read consecutively as input to the array of the nine chance locations 45 on the deal screen. All games are on chip modules. Each module has as many as 50 deals per module.

Another feature of this invention is the auditing of games and licensing information for the regulatory agency. Each game chip module keeps a memory record of all play off that module. A telephone modem 30 as shown in FIG. 1 connects the information collected by the AUDIT subroutine in order for it to be stored and printed (27) out at a central computer facility operated at a remote location. In particular the deal retirement information is as follows:

1) the total number of chances actually played;
2) the total amount of actual winning chances redeemed;
3) the total value of unsold chances within the deal;
4) the value of unredeemed winners;
5) the actual profit for the particular deal;
6) the date the deal was put in play and the date it was retired;
7) the serial number of the particular deal.

In addition, game identification and client information would include the following:

1) the name of the game;
2) game memory chip device number;
3) game manufacturer numbers;
4) total number of chances within each deal of the game (common to all deals within the game);
5) total value of all winners within each deal of the game (common to all deals);
6) price per chance (common to all chances within a game); and client/customer identification as follows:
1) name of the client, customer, or casino owner;
2) state granted license number or permit of the client, customer or casino owner;
3) expiration date of such license or permit;
4) address where the gaming device is located.

Such deal audit information can be printed out as requested.

The deals can be retired either after all winning chances have been redeemed, or under the major win rule or under the last sale feature as follows:

1. Major Win Rule: This is the procedure of playing a deal only as long as at least one of the higher level winners (→50 times price of a single chance) remains available to be won within the deal. After all of the higher level winners have been redeemed the deal is retired from play and the next deal for that game (if any remain) is electronically placed in play as a new deal. Thus a deal can possibly actually lose money if the randomized placement of winners within that deal lead to the winners being selected by the player prior to enough losers being played to cover the profit of the game. An electronic game using the major win rule is a distinctive feature of the device disclosed. The size of what is considered a major winner may vary from one client to another and from one bet denomination game to another. Games which have bet sizes of twenty-five cents may more commonly have major win definitions which are equal to or greater than 40 times bet or $10.00. The client has the ability to define the sizes of major winners. The auditing program also keeps a record of the dates of major wins and their amounts.

2. Last Sale Feature: The last sale feature works as an inducement to players to acquire all of the chances in a game. The very last chance available awards them a certain prize, usually one of a higher level. In cases where the last sale feature is provided, the games are played completely through the last chance in the deal. This would mean that all of the deals in a particular game would have the same actual payout and profit.

Figure 1B:
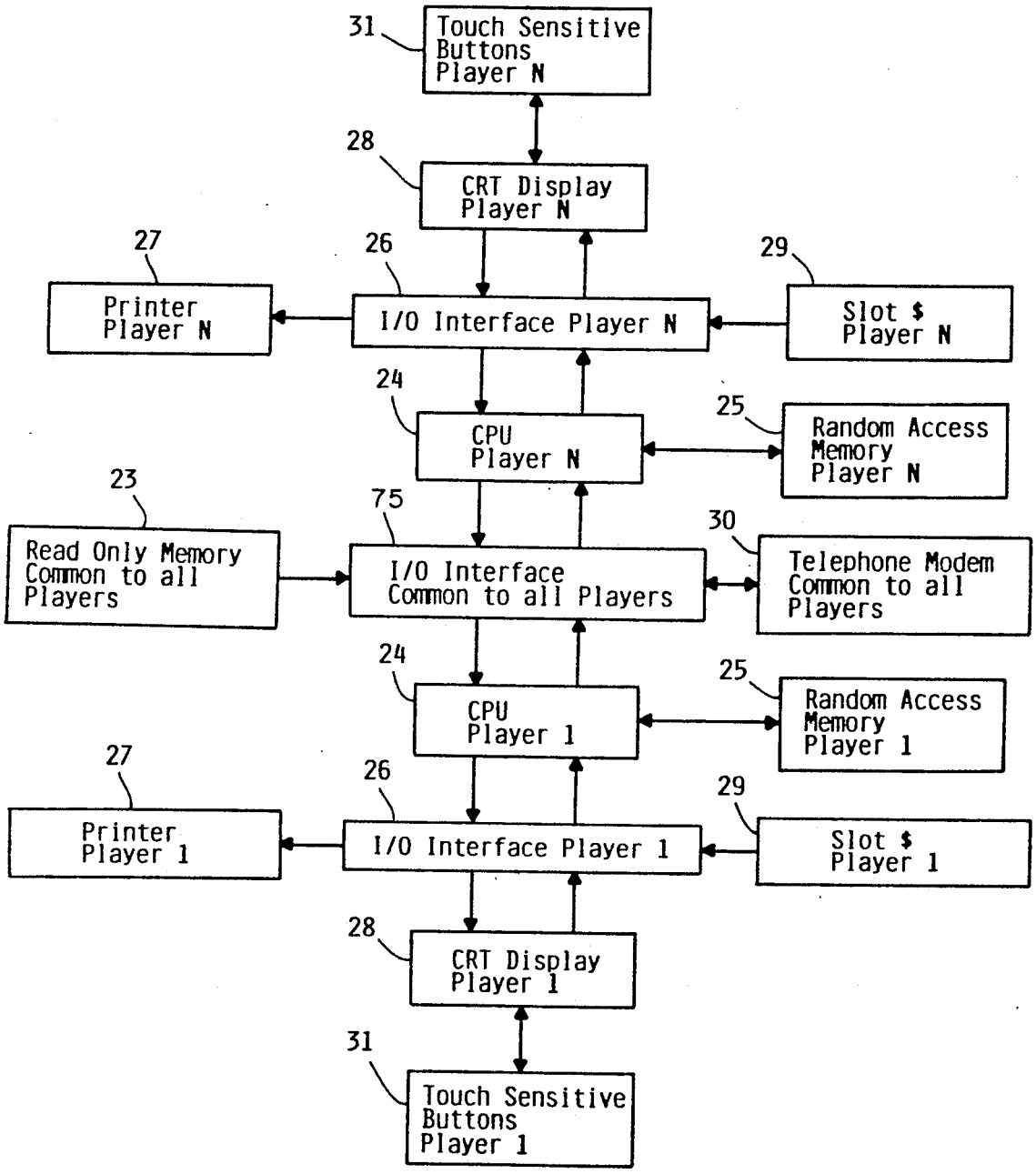
FIG. 1B is a configuration, as in FIG. 1A, for a plurality of players to play the same game in competition.

In addition to the embodiments previously discussed, there is disclosed in FIG. 1B a further embodiment comprising a plurality of video screens (CRT Display) 28 connected to a common games database having the ability to communicate with software for a plurality of games while a plurality of players compete with each other. In the preferred embodiment, only certain predetermined games are programmed for group, competitive play. In this alternate embodiment the video screens function as terminals, each of which has its own game software but sharing some common games databases and auditing information. The video screen terminals may be set low enough that a plurality of players can see and talk to one another while playing the same deal within a game. This provides a social element and a feeling of sports competition among some players who enjoy racing to see who wins first. Each player initiates play on his machine by putting money in a slot or bill acceptor 29. As with the single player mode of FIG. 1A, each player selects a particular game, e.g. Buried Treasure 40, FIG. 4, by pressing a touch sensitive button 31 on his video screen. Play by each person is the same as described above and as illustrated in FIGS. 2, 4, 5A and 5B. The interface 75 is embodied as a plurality of buses, one for each player's processor 24 and connecting it to the other players' processors 24. A bus controller is a computer program residing in any processor 24 with the other processors 24 acting as backups. The bus controller will monitor the transmission of data updates along the buses to and from each processor which, in turn, sends data to update its RAM 25 in the AUDIT subroutine. This processing insures that the current polling of available chances is available at each player's gaming device and displayed on the video screens 28.

The foregoing descriptions do not limit the invention, but are intended to instruct a skilled computer programmer and engineer how to implement the same on various hardware and software configurations.

What is claimed is:

1. A computerized video device for playing games of chance comprising:

a processing means for processing game data;

a plurality of game programs residing in a computer memory device, each said game program having a preset number of identical deals, and each said deal representing a finite number of chances to win, and having winning chances paying a predetermined amount of money;

a video display means for displaying game and deal offers wherein each deal offer represents an array of unrevealed chances;

an input means for signalling a player's selections to said processing means;

an output means for revealing selected chances and displaying winning amounts.

2. A computerized video device as in claim 1 wherein the processing means further comprises a comparing means for comparing the player's selections with winning chances.

3. A computerized video device as in claim 1 wherein the processing means further comprises a random number generating means for selecting said deal chances.

4. A computerized video device as in claim 3 wherein the random number is an integer from 1 to the maximum number of deal chances in a particular game.

5. A computerized video device as in claim 1 wherein the game programs further comprise the randomized storing of deal chances in memory addresses.

6. A computerized video device as in claim 1 in which the deal chances further comprise sets of a plurality of predetermined symbols.

7. A computerized video device as in claim 1 wherein said video display means further comprises a selection means offering the player a chance of a plurality of games, each comprised of finite chance deals from which he chooses all or some of an array of unrevealed chances.

8. A computerized video device as in claim 7 wherein said video display means further comprises a selection means offering the player the option of selecting a new array of unrevealed chances in the current game.

9. A computerized video device as in claim 7 wherein said video display means further comprises a selection means offering the player the option of exiting the current game to select a new game.

10. A computerized video device as in claim 7 wherein said display means further comprises a selection means offering the player the option of quitting play.

11. A computerized video device as in claim 1 wherein said processing means, said game programs and said video display means further comprises means for determining and displaying the approximate percentage of chances remaining in a particular deal.

12. A computerized video device as in claim 1 wherein said processing means further comprises means for returning said deal chances not chosen to the deal for future selection and deleting any chosen chances from said deal.

13. A computerized video gaming device as in claim 1 wherein said processing means further comprises means for retiring a deal after the last available chance is exhausted.

14. A computerized video gaming device as in claim 1 wherein said processing means comprises means for retiring a deal after all the major winning chances are won.

15. The computerized video device as in claim 1 wherein the memory device further comprises a portable read only memory device encoded with licensing data which is capable of being read only in similarly encoded computerized devices.

16. A computerized video device as in claim 1 further comprising:

a plurality of said devices sharing a common game program; and interfacing means for communicating game update data between each said device whereby said players can compete with each other while playing the same deal of a game simultaneously.

17. A computerized video device as in claim 16 wherein:

each of said plurality of devices is so programmed as to permit individual and exclusive play of all of said plurality of game programs except said common game program.

18. A computerized video device as in claim 16 wherein:

said devices are located in such a manner that each player can see and converse with the other players.

19. A computer game of chance method comprising the steps of:

generating a deal database for each of a plurality of games, each deal having a finite number of sets, each set comprising a plurality of predetermined symbols;

designating predetermined ones of said sets representing winning chances and the amount each said set pays out;

offering the player a choice of said plurality of games;

randomly generating the order of appearance of a plurality of said sets comprising an array of chances offered to a player from the current deal, whereby a player may select a particular game and choose unrevealed chances, the player having the option to choose all, one, or more than one of said chances;

comparing the selected chances to the sets of winning chances and displaying any winning amounts;

revealing the symbol sets represented by said chosen chances and subtracting only said sets from the deal for future selection.

20. A computer game method as in claim 19 wherein the deal status of the current game is computed and displayed, and wherein status includes the approximate percentage of chances remaining in a particular deal.

21. A computer game method as in claim 20 wherein said deal status further includes the number of major winners remaining.

22. A computer game method as defined in claim 21 wherein said deal status further includes the percentage of payouts when the deal is new.

23. A computer game method as in claim 19 wherein each set is comprised of three symbols.

24. A computer game method as in claim 19 wherein a particular deal is retired after exhausting the last chance.

25. A computer game method as in claim 19 wherein a particular deal is retired after all the major winning chances have been selected.

26. A computer game method as in claim 19 wherein said array is comprised of nine chances representing nine symbol sets at a time.

27. A computer game method as in claim 19 wherein the random generation of a set's order of appearance comprises the determining of a random number from 1 to the maximum number of chances in a particular deal, and said random number locating the relative position of said selected set within said deal database.

* * * * *